US008192547B2

(12) United States Patent
Gotthold et al.

(10) Patent No.: US 8,192,547 B2
(45) Date of Patent: Jun. 5, 2012

(54) THERMALLY ISOLATED CRYOPANEL FOR VACUUM DEPOSITION SYSTEMS

(75) Inventors: David William Gotthold, Lino Lakes, MN (US); Richard Charles Bresnahan, Cottage Grove, MN (US); Scott Wayne Priddy, Saint Louis Park, MN (US); Mark Lee O'Steen, Centerville, MN (US)

(73) Assignee: Veeco Instruments Inc., Woodbury, NY (US)

( * ) Notice: Subject to any disclaimer, the term of this patent is extended or adjusted under 35 U.S.C. 154(b) by 1266 days.

(21) Appl. No.: 11/903,727

(22) Filed: Sep. 24, 2007

(65) Prior Publication Data

US 2008/0134975 A1 Jun. 12, 2008

Related U.S. Application Data

(60) Provisional application No. 60/846,943, filed on Sep. 25, 2006.

(51) Int. Cl.
*C23C 16/00* (2006.01)

(52) U.S. Cl. ..... 118/724; 118/726

(58) Field of Classification Search ..... 118/724, 118/726

See application file for complete search history.

(56) References Cited

U.S. PATENT DOCUMENTS

| | | | | |
|---|---|---|---|---|
| 3,446,422 | A | | 5/1969 | Bailleul-Langlais et al. |
| 4,873,833 | A | * | 10/1989 | Pfeiffer et al. ..... 62/55.5 |
| 5,788,776 | A | | 8/1998 | Colombo |
| 5,951,767 | A | | 9/1999 | Colombo |
| 6,367,267 | B1 | | 4/2002 | Colombo |
| 6,718,775 | B2 | | 4/2004 | Colombo et al. |

FOREIGN PATENT DOCUMENTS

GB 1 225 608 3/1971

* cited by examiner

*Primary Examiner* — Karla Moore

(57) ABSTRACT

The present invention relates to vacuum depositions systems and related deposition methods. Vacuum deposition systems that use one or more cyropanels for localized pumping of a deposition region where a substrate is positioned are provided. The present invention is particularly applicable to pumping and minimizing reevaporation of high vapor pressure deposition materials during molecular beam epitaxy.

11 Claims, 13 Drawing Sheets

THERMALLY ISOLATED CRYOPANEL FOR VACUUM DEPOSITION SYSTEMS

CROSS-REFERENCE TO RELATED APPLICATION

The present application claims priority to U.S. Provisional Application No. 60/846,943, filed Sep. 25, 2006, the entire contents of which are incorporated herein by reference.

TECHNICAL FIELD

The present invention relates to vacuum depositions systems and related deposition methods. More particularly, the present invention relates to vacuum deposition systems that use one or more cyropanels for localized pumping of a deposition region where a substrate is positioned. The present invention is particularly applicable to pumping and minimizing reevaporation of high vapor pressure deposition materials during molecular beam epitaxy.

BACKGROUND

Various techniques can be used to grow materials used in semiconductor devices. One popular technique is molecular beam epitaxy. Generally, in a molecular beam epitaxy deposition process, thin films of material are deposited onto a substrate by directing molecular or atomic beams to a deposition region where a substrate is positioned, typically by a substrate manipulator capable of heating the substrate. Deposited atoms and molecules migrate to energetically preferred lattice positions on the heated substrate, yielding film growth of high crystalline quality and purity, and optimum thickness uniformity. Molecular beam epitaxy is widely used in compound semiconductor research and in the semiconductor device fabrication industry, for thin-film deposition of semiconductors, oxides, metals and insulating layers.

Conventional molecular beam epitaxy growth chambers typically use a liquid nitrogen filled cryogenically cooled shroud (cryoshroud or cryopanel) that substantially surrounds and encloses the active growth region. The cryoshroud functions to pump the growth chamber, particularly the growth region, by condensing residual species, especially volatile high vapor pressure species, not removed or trapped by the primary vacuum pumping system. The cryoshroud can also enhance the thermal stability and temperature control of critical growth reactor components such as effusion sources and can condense and trap source material emitted from the effusion cells but not incorporated into the growing film.

One challenge associated with certain molecular beam epitaxy processes, such as those for growth of nitride and oxide materials relates to the significant amount of gas that needs to be pumped away to maintain the desired vacuum level for the growth environment. In a typical molecular beam epitaxy deposition system, gas can be pumped by the cryopanel of the growth reactor. However, because gases used for growth of materials such as nitrides and oxides often have a generally high vapor pressure, such gases are susceptible to being reevaporated from the cryopanel. For example, radiant heat can impinge upon different surface portions of the cryopanel or adjacent chamber structure at different times during a typical deposition process because of the opening and closing of shutters on effusion sources or other heat sources or instruments. This can cause a surface portion of the cryopanel to vary in temperature during a deposition process which can cause gas to be pumped when the surface portion is cold enough and reevaporated when the surface portion increases in temperature.

SUMMARY

The present invention thus provides vacuum deposition systems that include one or more cyropanels for use with deposition processes such as those that use high vapor pressure deposition materials. A cryopanel in accordance with the present invention is preferably substantially isolated from any source of heat of the deposition system in which it is used that could cause reevaporation of a gas pumped by and condensed onto a surface of the cryopanel. It is particularly desirable to minimize reevaporation of such pumped gas into a deposition region where a substrate is positioned for a deposition process. A cryopanel in accordance with the present invention is thus preferably isolated from liquid based cooling panels, shrouds, or the like, used to cool deposition sources, substrate heaters, or other components or instruments of the deposition system which could potentially provide a heat load to the cryopanel. Also, the cryopanel is preferably shielded from radiant heat generated by such heat sources. Such shielding preferably minimizes the amount of radiant heat that can impinge on pumping surfaces of the cryopanel without substantially affecting the pumping conductance to such pumping surfaces. A thermally isolated and radiatively shielded cryopanel in accordance with the present invention can thus locally pump a deposition region where a substrate is positioned and provide optimal pressure stability for the deposition process.

In one aspect of the present invention an ultra high vacuum deposition system comprising a distinct cryogenic pumping panel is provided. The deposition system preferably comprises a vacuum chamber and a cooling and pumping system. The vacuum chamber typically comprises a deposition region wherein a substrate can be positioned for deposition and a port that can operatively position a source of deposition material relative to the deposition region. The cooling and pumping system preferably comprises a liquid cooling panel and a cryogenic pumping panel. The liquid cooling panel preferably at least partially surrounds the deposition region. The cryogenic pumping panel is preferably distinct (i.e., separate from) from the liquid cooling panel and at least partially surrounding the liquid cooling panel. The liquid cooling panel preferably substantially shields the cryogenic pumping panel from thermal radiation generated by the source of deposition material when the source of deposition material is positioned in the port.

In another aspect of the present invention a cooling and pumping system for an ultra high vacuum deposition system is provided. The cooling and pumping system preferably comprises a liquid cooling panel and a cryogenic cooling panel. The liquid cooling panel preferably comprises a body portion and a neck portion extending from the body portion. The cryogenic pumping panel is preferably distinct from the liquid cooling panel, nested with, and at least partially surrounds the neck portion of the liquid cooling panel.

In yet another aspect of the present invention a method of providing a vacuum environment for an ultra high vacuum deposition process is provided. The method preferably comprises the steps of providing a deposition system, pumping the deposition system with a cryogenic pumping panel, and shielding the cryogenic pumping panel from thermal radiation generated within the deposition system. The deposition system preferably comprises a vacuum chamber having a deposition region wherein at least one substrate can be positioned for deposition and at least one source of deposition material operatively positioned relative to the deposition region. The cryogenic pumping panel is preferably positioned within the vacuum chamber and relative to the deposition region and contains a cryogenic fluid. The step of shielding the cryogenic pumping panel from thermal radiation preferably comprises shielding the cryogenic pumping panel with a liquid cooling panel comprising liquid coolant. The liquid cooling panel is preferably distinct from the cryogenic pumping panel and at least partially surrounds the deposition region. The thermal radiation is often generated by one or more of a source of deposition material, a substrate heater, and measurement instruments such as vacuum gauges and the like.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1:
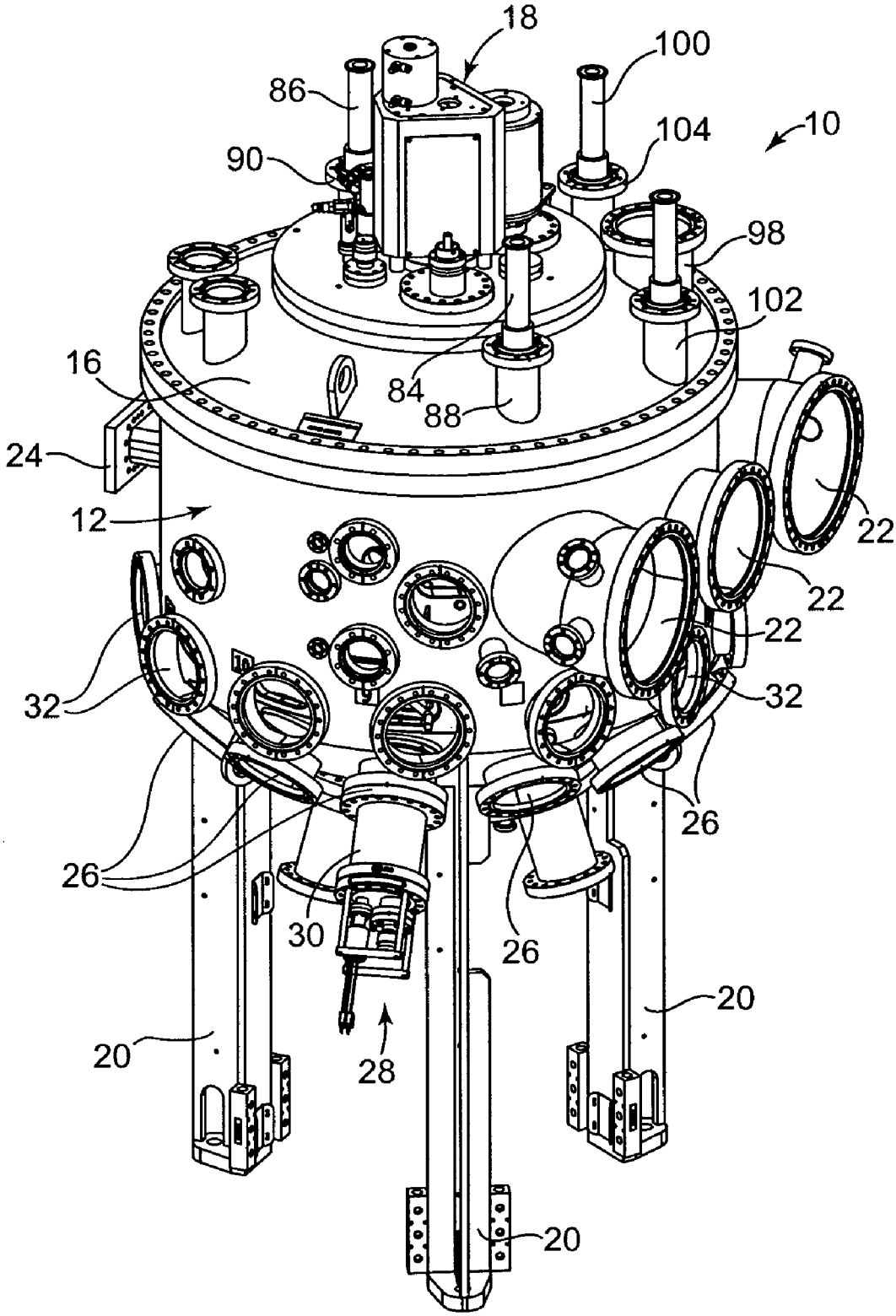
FIG. 1 is a perspective view of an exemplary vacuum deposition system in accordance with the present invention.
Figure 2:
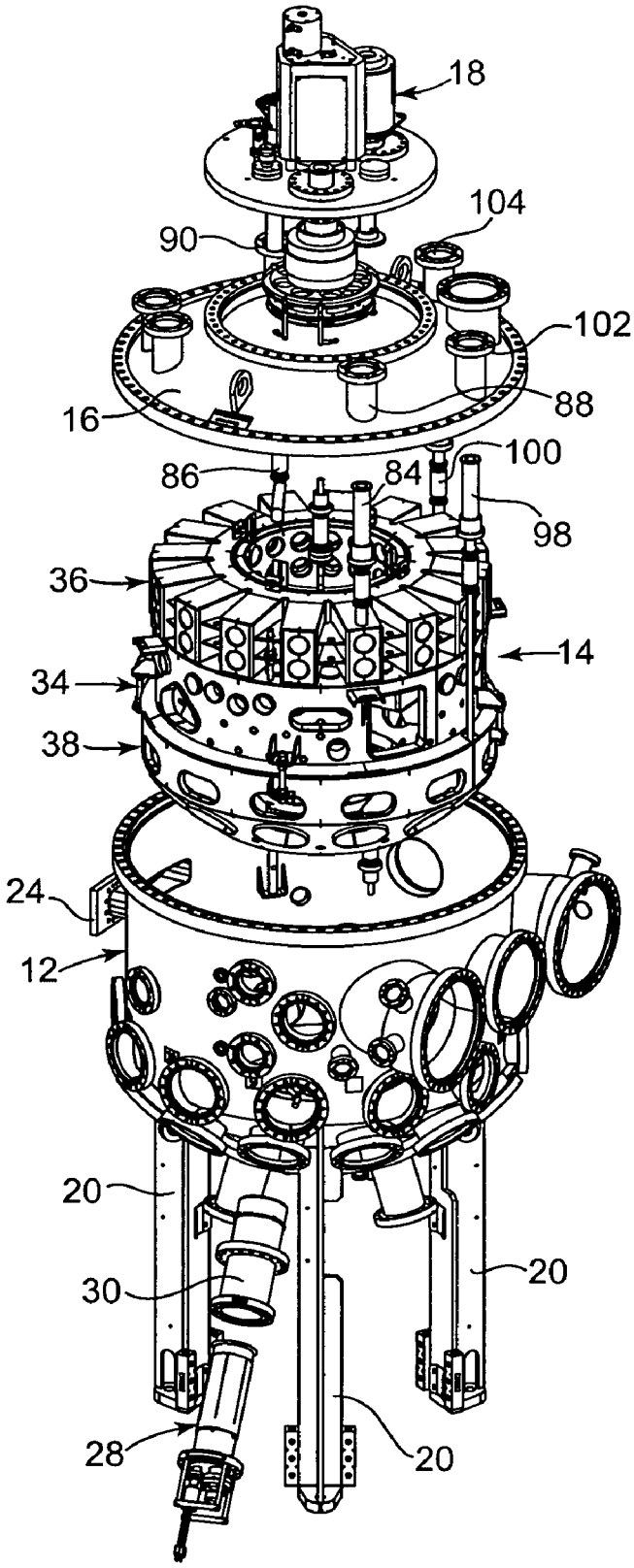
FIG. 2 is an exploded view of the vacuum deposition system of FIG. 1 showing a vacuum chamber, pumping and cooling system, top flange, substrate manipulator, and deposition source.

Referring initially to FIGS. 1 and 2 an exemplary vacuum deposition system 10 in accordance with the present invention is illustrated. In FIG. 1 a perspective view of deposition system 10 is shown and in FIG. 2 an exploded view is shown. Generally, deposition system 10 comprises vacuum chamber 12, pumping and cooling system 14, top flange 16, and substrate manipulator 18.

Vacuum chamber 12, as shown, is structurally supported by legs 20 and comprises a plurality of ports having vacuum flanges for attaching components such as deposition sources, shutters, pumps, windows, gauges, instrumentation, and the like to vacuum chamber 12. The configuration of the ports of illustrated vacuum chamber 12 is typical of that used for molecular beam epitaxy deposition and often depends on the desired materials to be deposited, desired system throughput, desired instrumentation for characterization and measurement, and space considerations at the location for deposition system 10, for example.

In the illustrated deposition system 10, ports 22 are preferably used for vacuum pumps and port 24 is preferably used to attach vacuum chamber 12 to another vacuum chamber (not shown) having a robot or transfer mechanism for providing substrates or substrate platens to substrate manipulator 18. Ports 26 are preferably used to position one or more sources of deposition material relative to a substrate positioned in a deposition region of vacuum chamber 12 by substrate manipulator 18. For example, exemplary deposition source 28 and cooling jacket 30 are illustrated. Also, ports 32 are preferably used to position shutters or the like relative to a deposition source positioned in a corresponding port 28. Deposition sources that can be used include those typically used for epitaxial growth such as effusion or Knudsen sources or crackers or the like as well as gas injectors or the like. Ports not specifically identified are typically used for one or more of windows, characterization equipment such as mass spectrometers or the like, shutter, electrical feedthroughs, and gauges such ion gauges for measuring vacuum levels.

Top flange 16, as shown, functions as a lid for vacuum chamber 12, provides additional ports for pumping and cooling system 14 as described below, and also supports and operatively positions substrate manipulator 18 relative to vacuum chamber 12. Substrate manipulator 18 comprises a mechanism that can position one or more substrates as held by a substrate holder or platen (not shown) or the like within a deposition region of the vacuum chamber 12 relative to the deposition sources. Typically, substrate manipulator 18 is capable of cooperating with a robot or transfer mechanism or the like to transfer a platen or the like between substrate manipulator 18 and another location such as a processing chamber, characterization chamber, or entry/removal chamber, for example. Substrate manipulator 18 is also preferably capable of controllably rotating and heating substrates held by a platen or the like in the deposition region. Substrate manipulators that provide such transfer, rotational, and heating functionality are well known in the art.

Pumping and cooling system 14 is shown in greater detail in FIGS. 3-11. Generally, pumping and cooling system 14 provides pumping and cooling functions for vacuum deposition system 10. Pumping is used for creating and maintaining a desired vacuum level in a deposition region where one or more substrates is positioned for deposition. Such pumping is achieved by providing surfaces at cryogenic temperature, cooled by liquid nitrogen for example, within vacuum chamber 12. Cooling is used to extract heat loads, usually radiative heat, from components such as depositions sources, for example. Cooling is achieved by providing surfaces near heat sources that can absorb heat from the heat sources and transfer the heat to a cooling fluid that can remove the heat from the deposition system 10 such as a water based cooling fluid or a cryogenic fluid that can provide a cooling function. For example, water jackets, shrouds, panels, or the like can be used.

In accordance with the present invention, a cryogenically cooled pumping surface is preferably substantially shielded from being impinged by thermal radiation without significantly affecting pumping efficiency. Such shielding prevents volatile gas species that have condensed on a cryogenically cooled surface (pumped) from being reevaporated as a result of being locally heated by thermal radiation. Preventing such reevaoration of volatile species helps to provide a stable vacuum level in vacuum chamber 12, particularly in the deposition region where one or more substrates is positioned. In a typical deposition system, significant thermal radiation is generated by the deposition sources and substrate heater and a pumping and cooling system in accordance with the present invention is preferably designed to shield cryogenic pumping surfaces from theses sources of heat. A pumping and cooling system in accordance with the present invention also preferably shields cryogenic pumping surfaces from other radiant heat sources such as gauges and instruments that typically include hot filaments or components.

The illustrated pumping and cooling system 14 provides pumping, cooling, and radiation blocking functionality in accordance with the present invention by using cooling panel 34 to help to shield upper cryogenic panel 36 and lower cryogenic panel 38 from radiative heat generated within vacuum chamber 12 that might otherwise impinge on upper cryogenic panel 36 and lower cryogenic panel 38. Cooling panel 34 is preferably designed to absorb radiative heat before such radiation can impinge on a cryogenically cooled surface of one or both of upper cryogenic panel 36 and lower cryogenic panel 38 and remove such heat from the deposition system 10. Preferably, a cooling fluid such as a water based cooling fluid is pumped through cooling panel 34 to remove heat provided by thermal radiation impinging on surfaces of cooling panel 34. Preferably, the temperature of the surfaces of cooling panel 34 is low enough to prevent condensing of gas species present in vacuum chamber 12 on such surfaces to minimize reevaporation of such gas.

Figure 8:
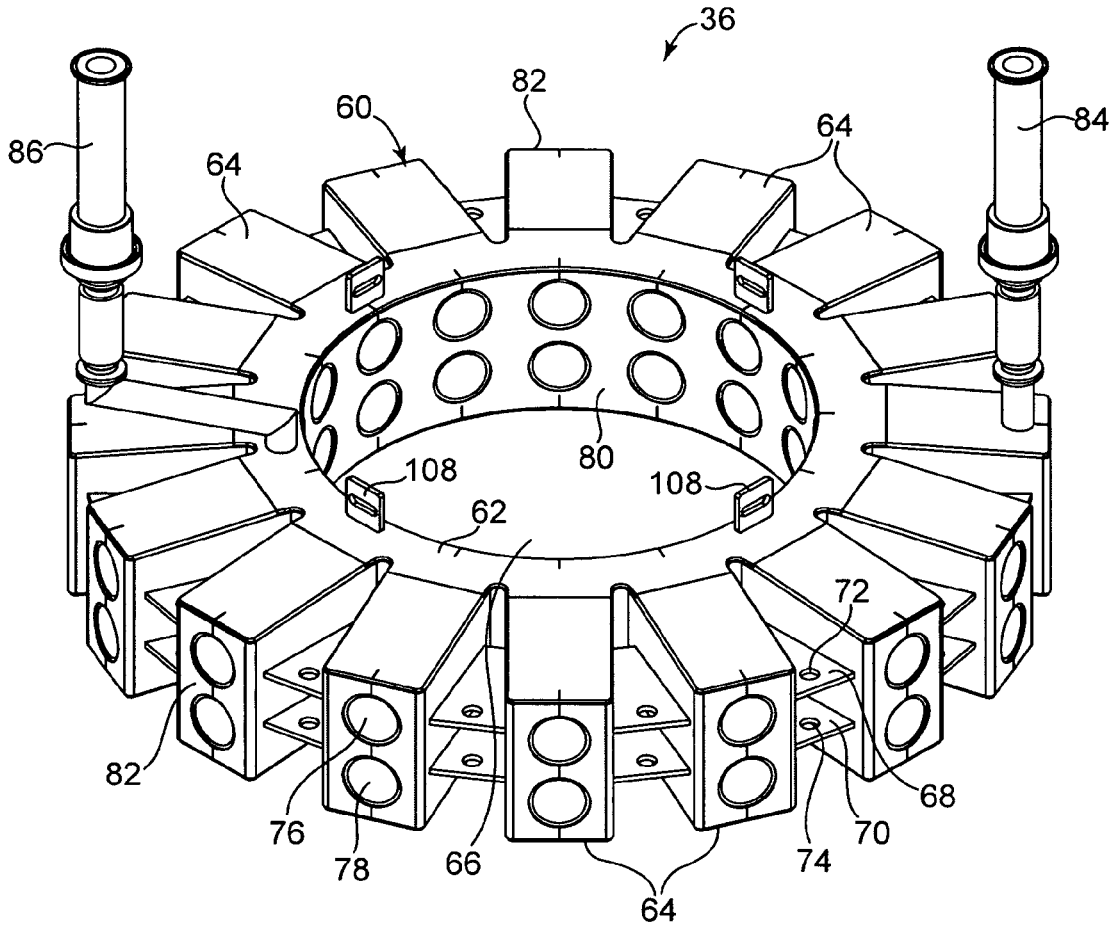
FIG. 8 is a perspective view of the upper cryogenic panel of the pumping and cooling system of FIG. 5 showing in particular an annular body having a central hub portion having a plurality of chambers extending radially therefrom.
Figure 9:
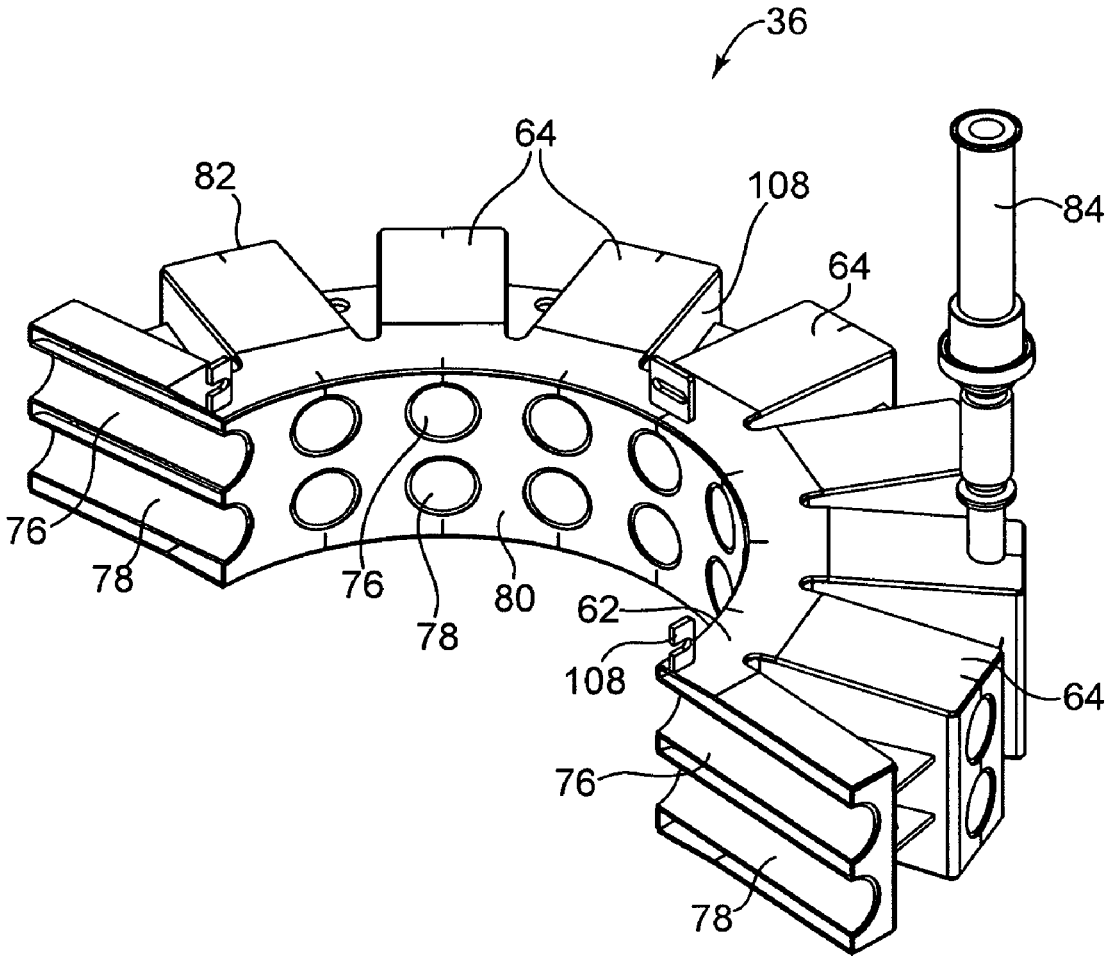
FIG. 9 is a perspective cross-sectional view of the upper cryogenic panel of FIG. 8.

Referring to FIGS. 8 and 9, a perspective and cross-sectional view of cooling panel 34 are shown. Cooling panel 34 is designed to permit the flow of cooling fluid through cooling panel 34. Thus, cooling panel 34 comprises fluid inlet 40, preferably at a low location of cooling panel 34, and fluid outlet 42, preferably at a high location of cooling panel 34. Positioning the fluid inlet and outlet this way helps to keep cooling panel 34 full of cooling fluid. Plural fluid inlets and outlets can be used.

As shown, cooling panel 34 comprises body portion 44 and neck portion 46. Body portion 44 comprises plural openings that function to provide one or more of openings or passageways for deposition source material, access for gauges and instrumentation, pumping conductance, and access for a robot or transfer mechanism. For example, openings 48 correspond with ports 26 for deposition sources of vacuum chamber 12 and allow deposition material to pass through cooling panel 34 during a deposition process as described in more detail below. Openings 48 are preferably separated by partitions 50, which preferably function to help isolated plural deposition sources and prevent cross-talk of deposition material during deposition processes. Opening 52 corresponds with port 24 of vacuum chamber 12 and allows a robot or transfer mechanism to access substrate manipulator 18. Openings 54 and 56 provide pumping conductance through cooling panel 34 to one or both of upper cryogenic panel 36 and lower cryogenic panel 38. As shown, each of openings 56 preferably comprise shield plate 58 that is positioned to block thermal radiation from deposition sources as described in more detail below. Neck portion 46 also comprises plural openings 49 that provide gas conductance to upper cryogenic panel 36 as described below.

Figure 10:
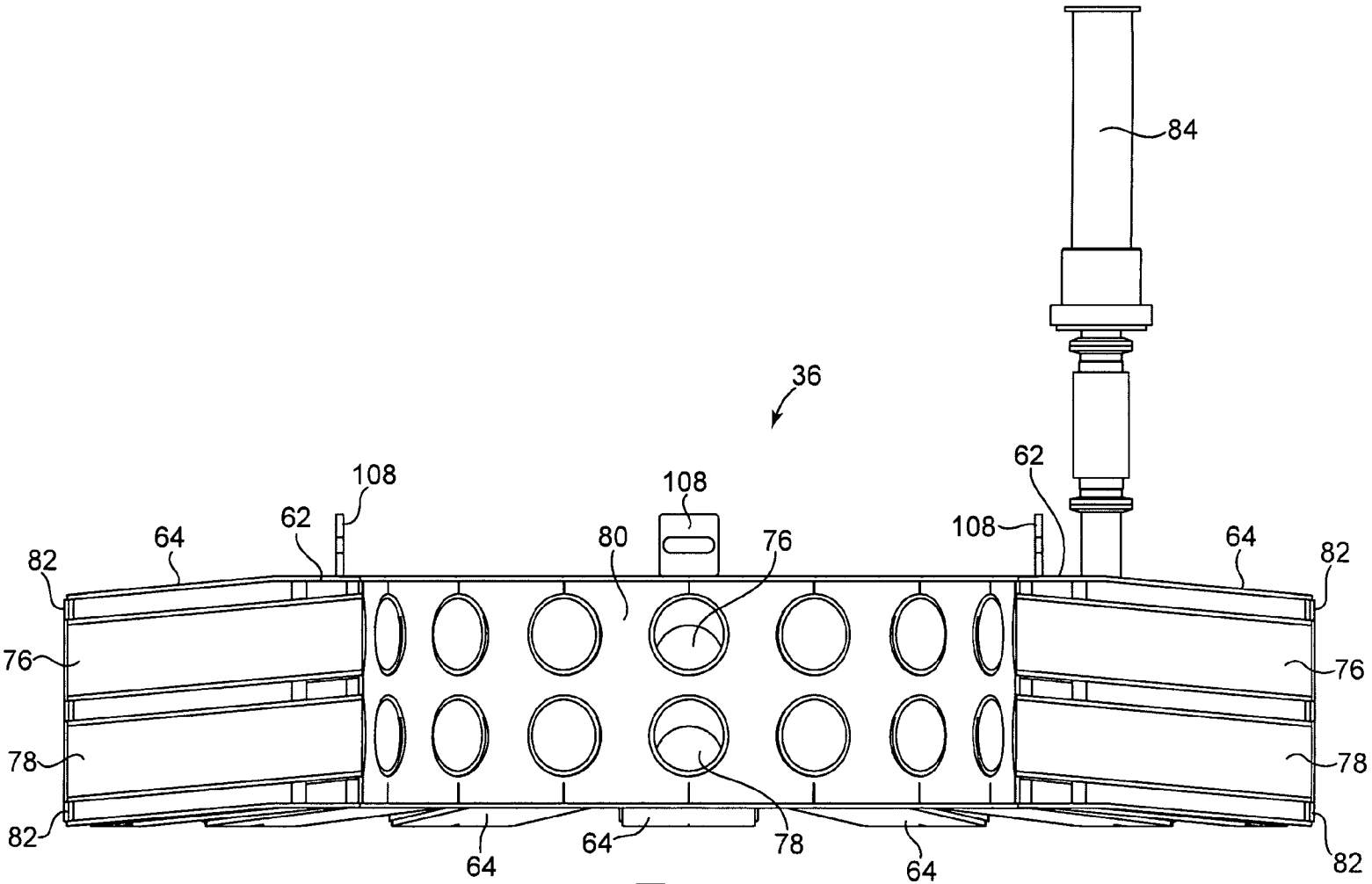
FIG. 10 a cross-sectional view of the upper cryogenic panel of FIG. 8 as viewed from a different direction from that of FIG. 9.

A perspective view of upper cryogenic panel 36 is shown in FIG. 8 and cross-sectional views are shown in FIGS. 9 and 10. The illustrated upper cryogenic panel 36 is exemplary and is preferably designed to maximize surface area that can be provided at cryogenic temperatures for pumping (and preferably minimizing the volume of cryogenic fluid used), maximizing conductance to such pumping surfaces, and also substantially preventing such pumping surfaces from being heated or otherwise warmed by direct impingement of thermal radiation on such surfaces or indirect heating of such surface by thermal conduction of heat from other portions of vacuum deposition system 10. Moreover, upper cryogenic panel 36 is also preferably designed to allow cryogenic fluid, such as liquid nitrogen or the like, to flow through cryogenic panel 36 with minimal turbulence as such turbulence can lead to localized warming of pumping surfaces and undesirable reevaporation of pumped gas.

Figure 3:
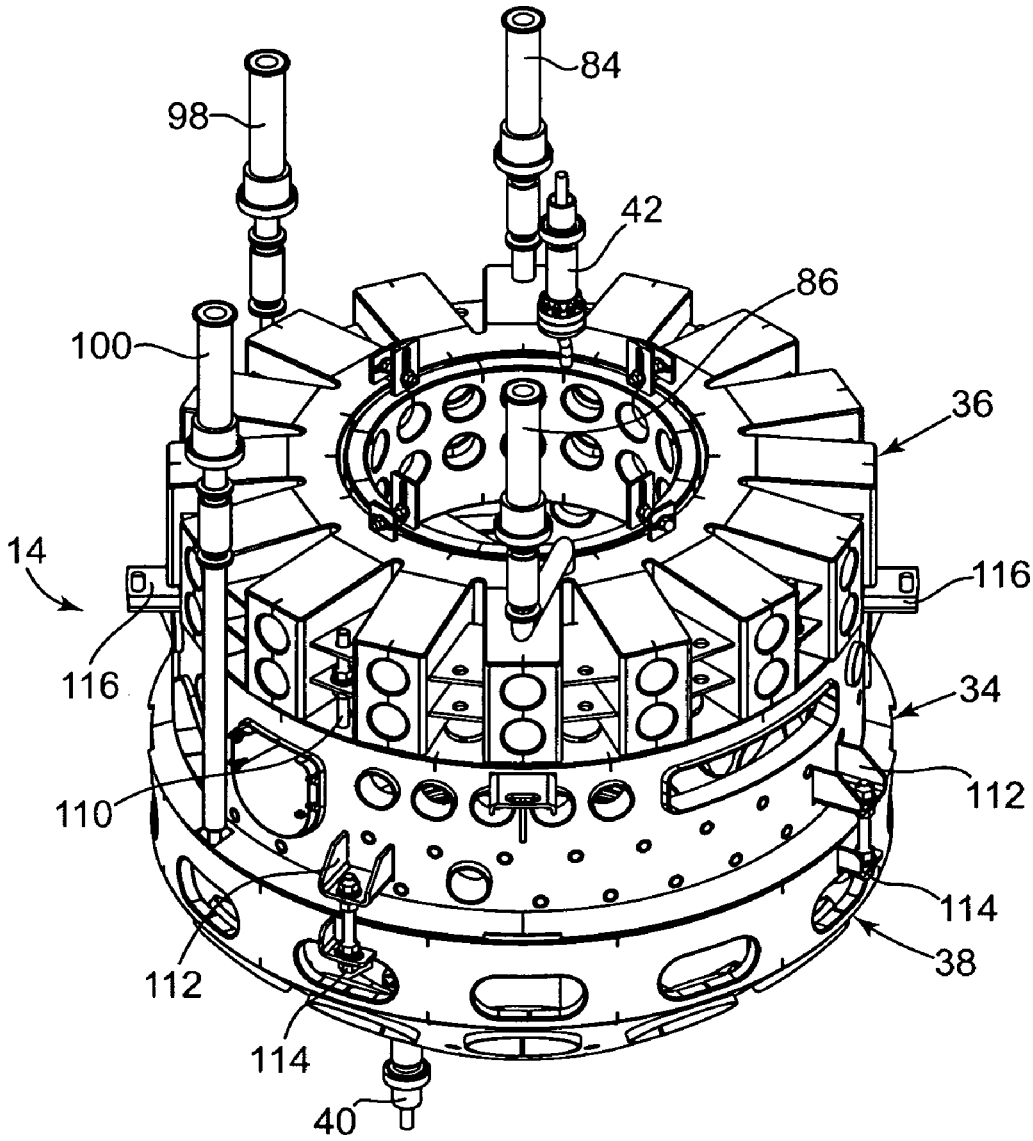
FIG. 3 is a perspective view of the pumping and cooling system shown in FIG. 2.
Figure 4:
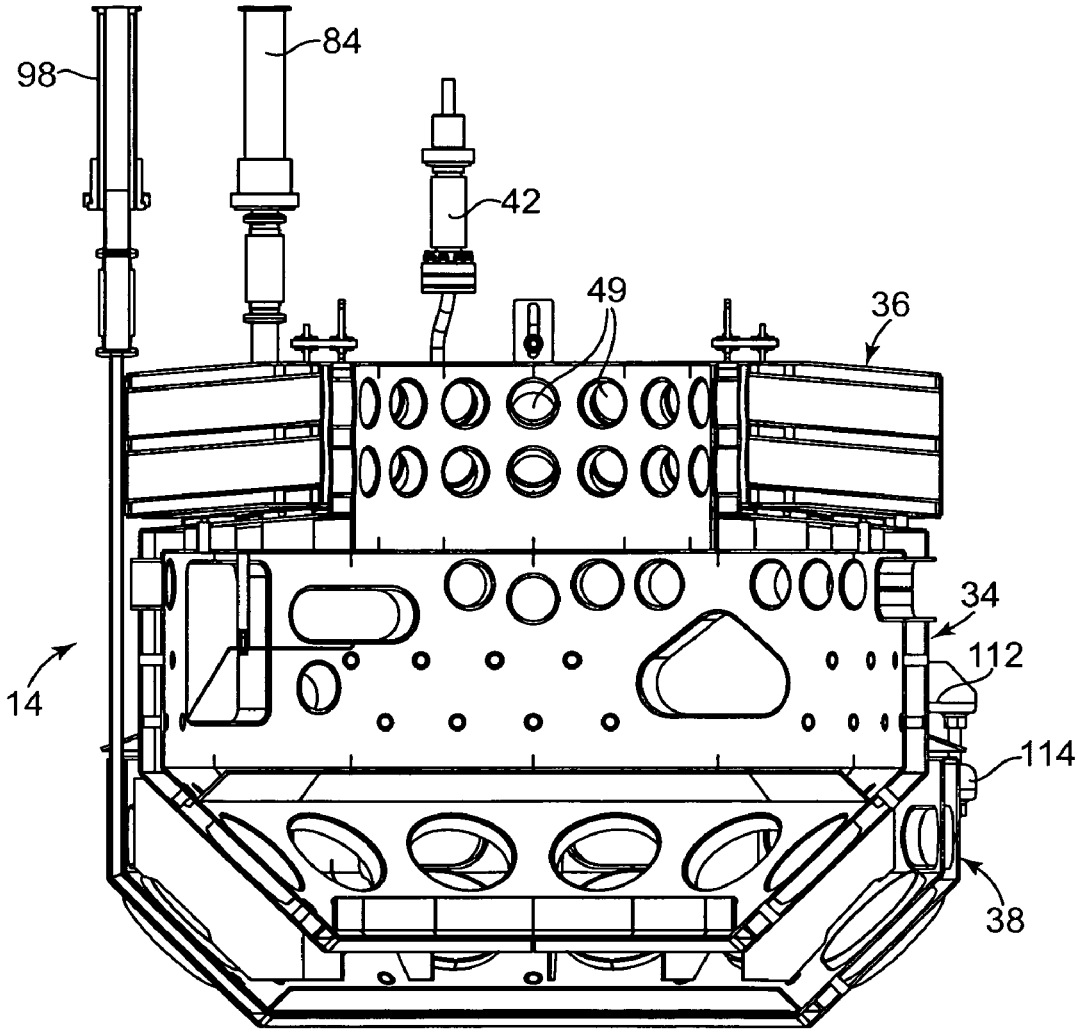
FIG. 4 is a perspective cross-sectional view of the pumping and cooling system of FIG. 4.
Figure 5:
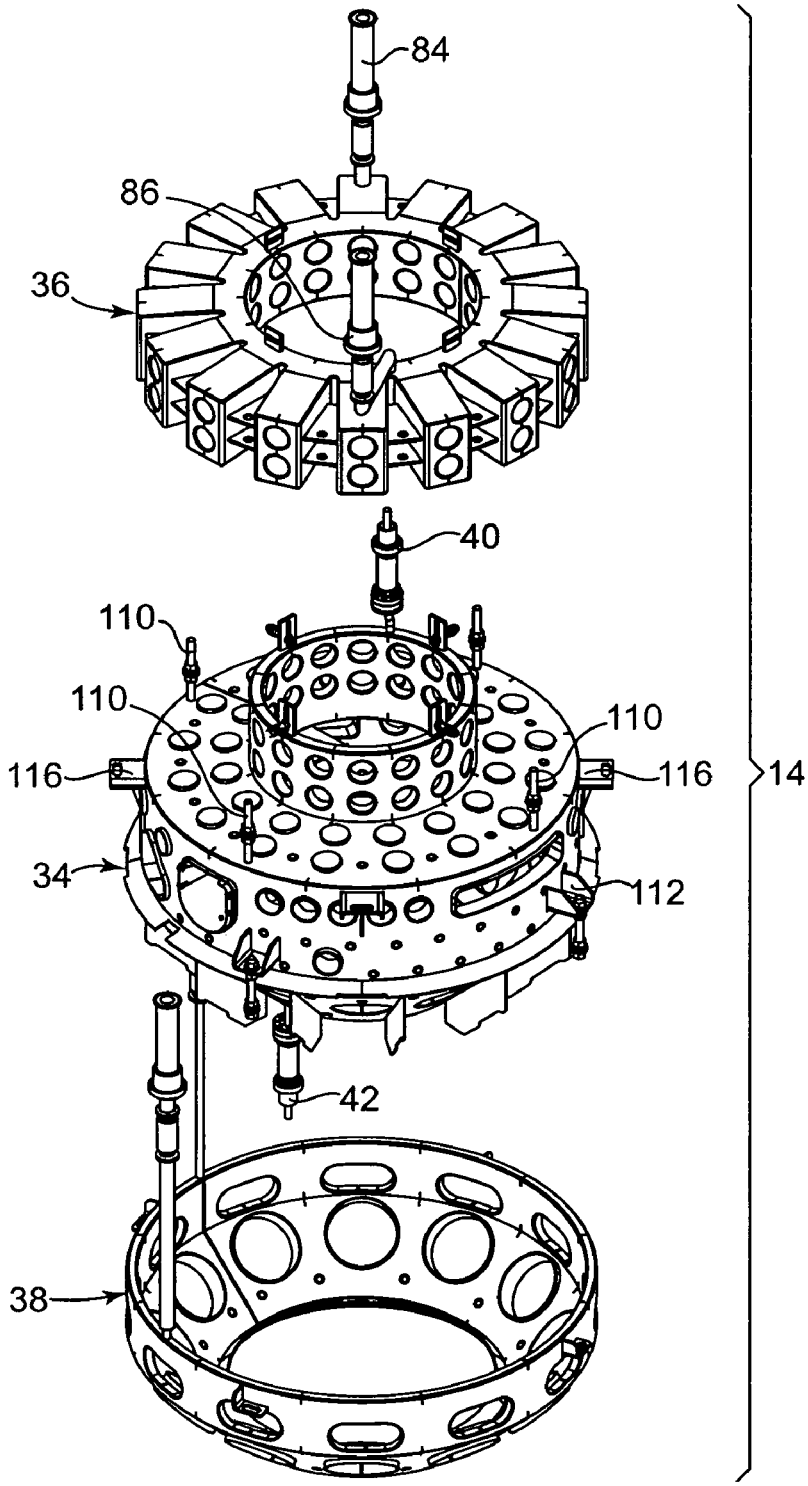
FIG. 5 is an exploded view of the pumping and cooling system of FIG. 3 showing in particular an upper cryogenic panel, a cooling panel, and a lower cryogenic panel.

Generally, as illustrated, upper cryogenic panel 36 comprises annular body 60 having central hub portion 62 and plural radially extending chambers 64. Central opening 66 nests with neck portion 46 of cooling panel 34 as can be seen in FIGS. 3 and 4 so neck portion 46 can substantially shield upper cryogenic panel 36 from thermal radiation in accordance with the present invention as is described in more detail below. Radially extending chambers 64 extend outwardly from central hub portion 62 and are each interconnected by first and second spaced apart plates, 68 and 70, respectively. Plates 68 and 70 function to structurally interconnect chambers 64 and help to prevent warping, twisting, or shifting of upper cryogenic panel 36 due to extreme temperature changes that can occur during filling of upper cryogenic panel 36 with cryogenic fluid, for example. Plates 68 and 70 also preferably include openings 72 and 74, respectively, to provide gas conductance through plates 68 and 70 or to connect upper cryogenic panel 36 with cooling panel 34 as described below.

Each of radially extending chambers 64 is preferably designed to maximize surface area and thus includes first and second tubes, 76 and 78, respectively, that laterally extend between inside surface 80 and outside surface 82 of annular body 60. Tubes 76 and 78 function to provide surface area for pumping and allow gas conductance between inside surface 80 and outside surface 82 of annular body 60. When nested with neck portion 46 of cooling panel 34, as shown in FIG. 3, openings 49 of neck portion 46 correspond and are aligned with tubes, 76 and 80 so gas from the deposition region where one or more substrates are positioned by substrate manipulator 18 can pass through openings 49 of neck portion 46 and be pumped by upper cryogenic panel 36.

Referring to FIG. 10, chambers 64 preferably extend away from hub portion 62 of annular body 60 and are tilted or angled downwardly with respect to hub portion 62. This allows any gas in the cryogenic fluid to accumulate at a high point rather that distributing along a surface and helps to maximize the surface area in contact with cryogenic fluid. As illustrated, tubes 76 and 78 are also preferably tilted downwardly. The downward tilt of tubes 76 and 78 helps to shield the inside surfaces of tubes 76 and 78 from impingement by thermal radiation as is described in more detail below.

Central hub portion 62 of annular body 60 and each of radially extending chambers 64 are preferably in fluid communication with each other. Upper cryogenic panel 36 includes fluid inlet 84 and fluid outlet 86, which preferably comprise liquid feedthroughs compatible with cryogenic fluid. Such feedthroughs are well known in the art. When assembled with vacuum deposition system 10, inlet 84 corresponds with and passes through port 88 of top flange 16 and outlet 86 corresponds with and passes through port 90 of top flange 16 as shown in FIGS. 1 and 2. In use, inlet 84 and outlet 86 are preferably connected to a phase separator or the like to provide a supply of cryogenic fluid to upper cryogenic panel 36.

Figure 11:
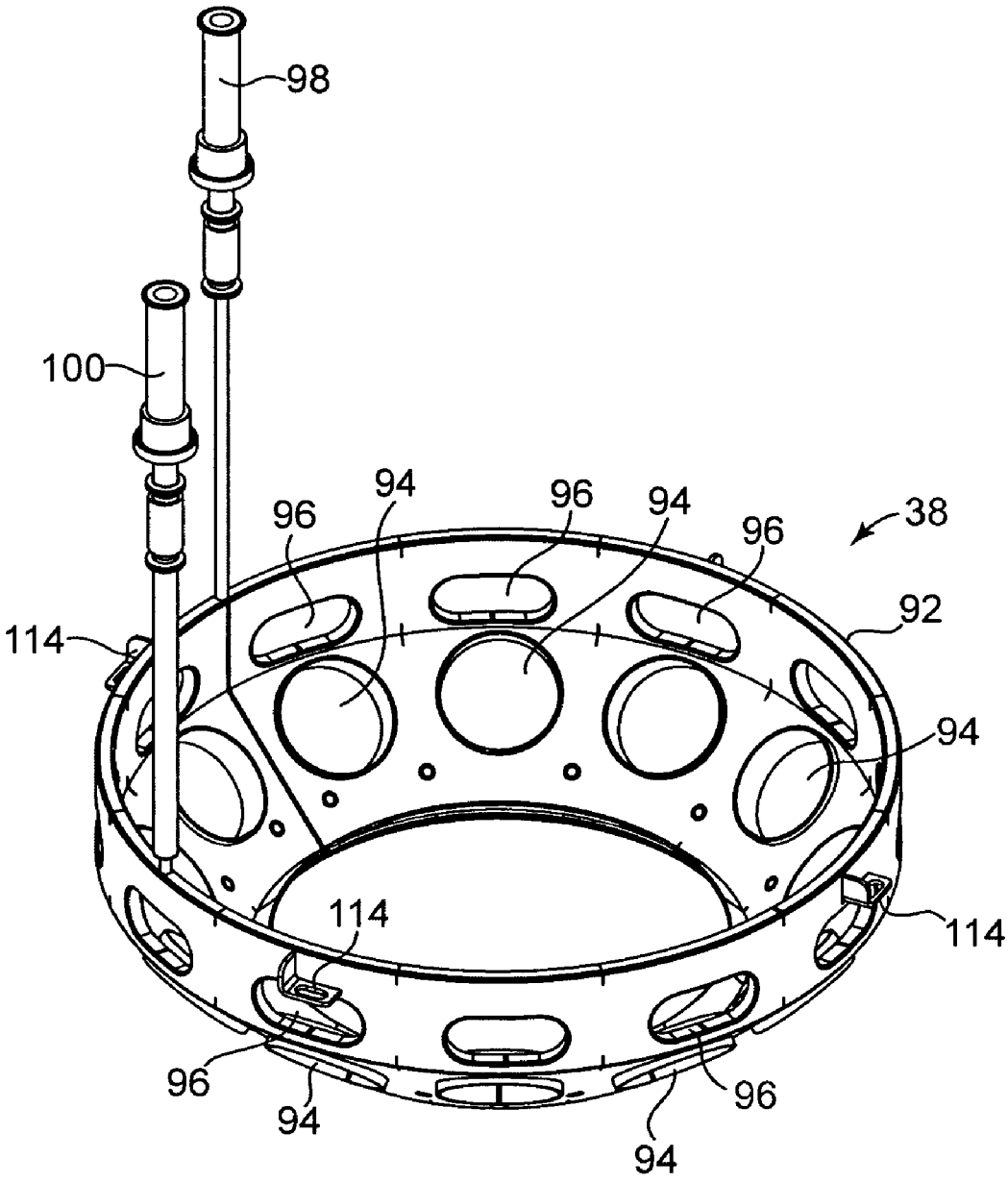
FIG. 11 is a perspective view of the lower cryogenic panel of the pumping and cooling system of FIG. 5.
Figure 12:
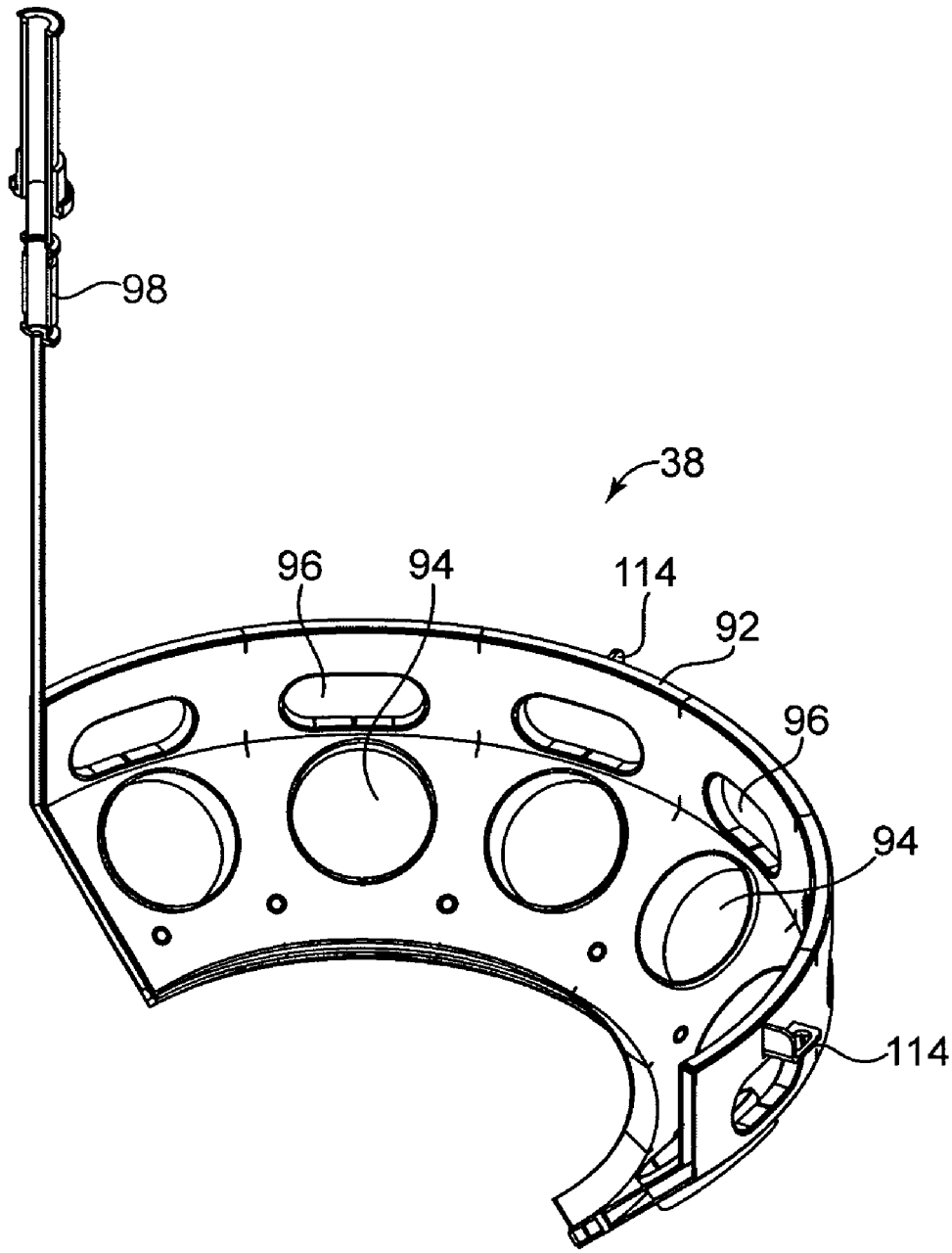
FIG. 12 is a perspective cross-sectional view of the lower cryogenic panel of FIG. 8.

A perspective view of lower cryogenic panel 38 is shown in FIG. 11 and a cross-sectional view is shown in FIG. 12. Like the upper cryogenic panel 36, the illustrated lower cryogenic panel 38 is exemplary and is also preferably designed to maximize surface area that can be provided at cryogenic temperatures for pumping (and preferably minimizing the volume of cryogenic fluid used), maximizing conductance to such pumping surfaces, and also substantially preventing such pumping surfaces from being heated or otherwise warmed by direct impingement of thermal radiation on such surfaces or indirect heating of such surface by thermal conduction of heat from other portions of vacuum deposition system 10. Lower cryogenic panel 38 is also preferably designed to allow cryogenic fluid, such as liquid nitrogen or the like, to flow through cryogenic panel 38 with minimal turbulence.

As shown, lower cryogenic panel 38 comprises a body 92 having a plurality of openings 94 that, when positioned within vacuum chamber 12, correspond with ports 26 for deposition sources. As described further below, openings 94 allow deposition material from deposition sources positioned in ports 26 to pass through lower cryogenic panel 38 to one or more substrates positioned in the deposition region by substrate manipulator 18. Body 92 of lower cryogenic panel 38 also comprises openings 96 that, when positioned within vacuum chamber 12, correspond with ports 32 for shutter assemblies.

Lower cryogenic panel 38 also includes fluid inlet 98 and fluid outlet 100, which preferably comprise liquid feedthroughs compatible with cryogenic fluid. Such feedthroughs are well known in the art. When assembled with vacuum deposition system 10, inlet 98 corresponds with and passes through port 102 of top flange 16 and outlet 100 corresponds with and passes through port 104 of top flange 16 as shown in FIGS. 1 and 2. In use, inlet 98 and outlet 100 are preferably connected to a phase separator or the like to provide a supply of cryogenic fluid to lower cryogenic panel 38.

Figure 6:
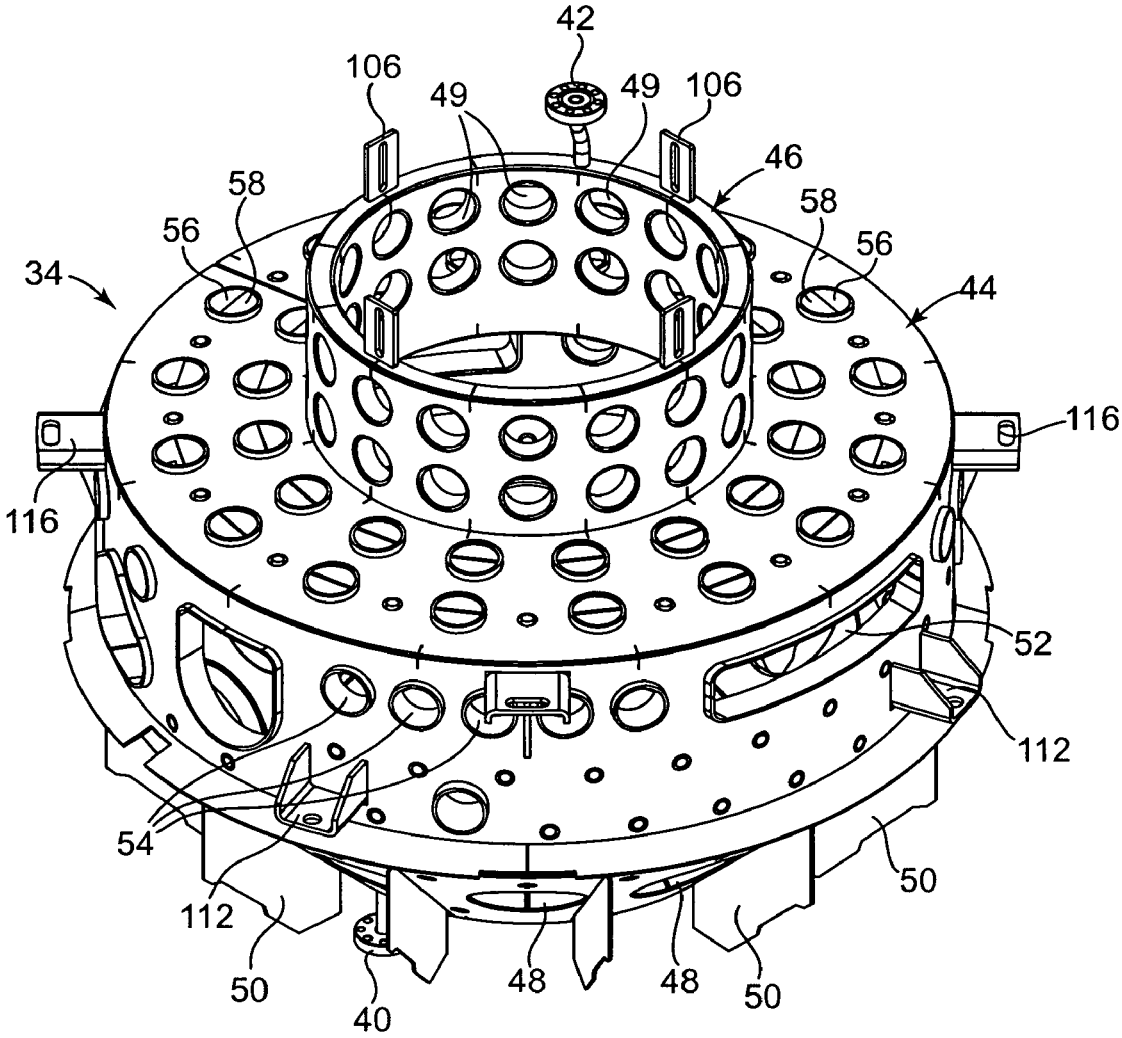
FIG. 6 is a perspective view of the cooling panel of the pumping and cooling system shown in FIG. 5 showing in particular a body portion and neck portion having conductance openings.
Figure 7:
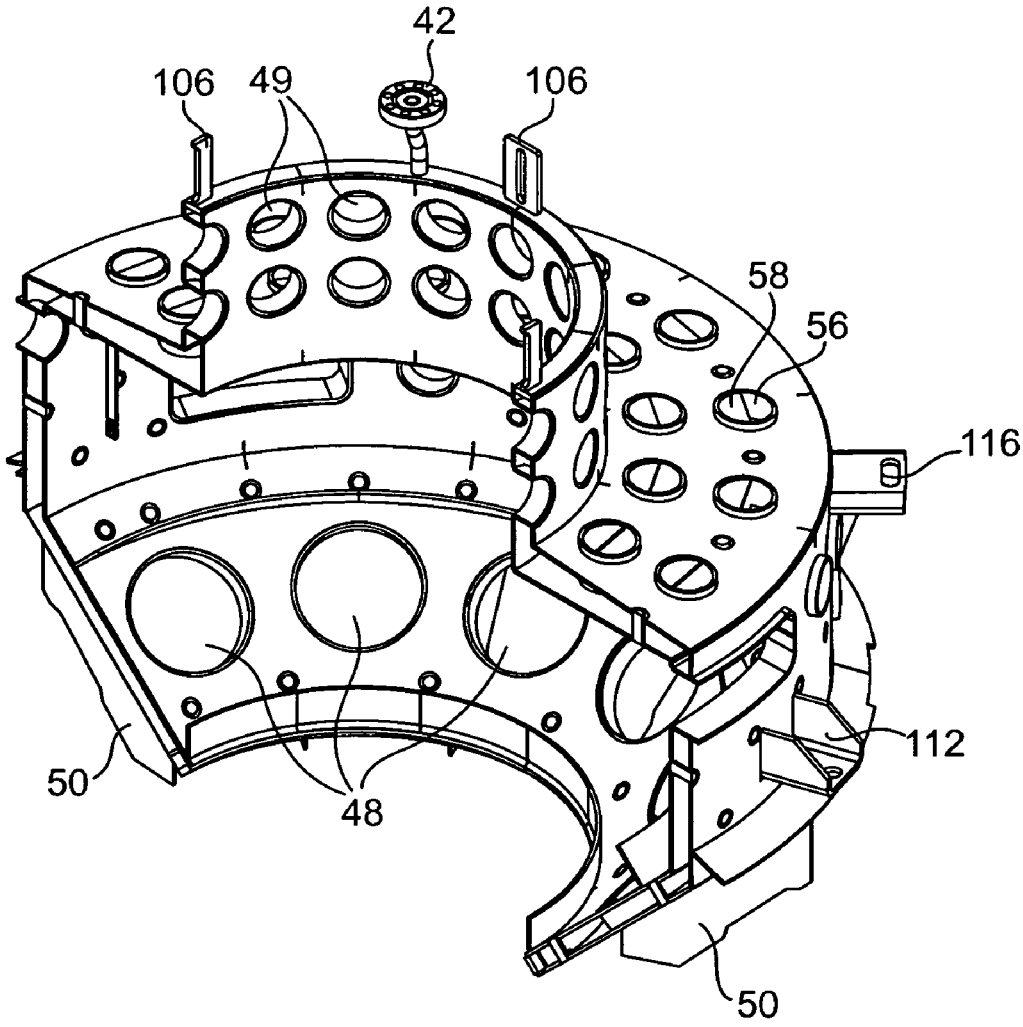
FIG. 7 is a perspective cross-sectional view of the cooling panel of FIG. 6.

Upper cryogenic panel 36 is preferably attached to cooling panel 34 in a way that minimizes thermal conduction between upper cryogenic panel 36 and cooling panel 34. Preferably, the structural connection between cooling panel 34 and upper cryogenic panel 36 (and lower cryogenic panel 38 as described below) is designed to minimize contact to thermally isolate the cryogenic panels from cooling panel 34. Such thermal isolation helps to prevent undesirable heating of one or both of upper and lower cryogenic panels 36 and 38, which could cause undesirable reevaporation. Referring to FIG. 6, cooling panel 34 includes mounting brackets 106 and referring to FIG. 8, upper cryogenic panel 36 includes mounting brackets 108. When assembled, as shown in FIG. 3, brackets 106 correspond with brackets 108 and bolts or the like are used to connect upper cryogenic panel 36 to cooling panel 34 by brackets 106 and 108. As also shown in FIG. 3, plural support rods 110 are also preferably used to support the weight of upper cryogenic panel 36 as assembled with cooling panel 34. As illustrated, support rod 110 comprises a threaded rod positioned in openings 72 and 74 of first and second plates 68 and 70 of upper cryogenic panel 36. Nuts are used with the threaded rod to adjustably position the upper cryogenic panel relative to the cooling panel 34.

Lower cryogenic panel 38 is also preferably attached to cooling panel 34 in a way that minimizes thermal conduction between upper cryogenic panel 36 and cooling panel 34. Referring to FIG. 6, cooling panel 34 includes mounting brackets 112 and referring to FIG. 11, lower cryogenic panel 38 includes mounting brackets 114. When assembled, as shown in FIG. 3, brackets 112 correspond with brackets 114 and bolts or the like are used to connect lower cryogenic panel 38 to cooling panel 34 by brackets 112 and 114.

Cooling and pumping system 14 is also preferably substantially thermally isolated from vacuum chamber 12. Accordingly, the connection between cooling and pumping system 14 and vacuum chamber 12 is preferably designed to minimize contact and thus minimize thermal conduction between vacuum chamber 12 and cooling and pumping system 14. Referring to FIG. 6, cooling panel 34 preferably comprises mounting brackets 116 that are preferably used to attach, support, and position cooling and pumping system 14 within vacuum chamber 12 by corresponding mounting brackets (not shown) within vacuum chamber 12.

Figure 13:
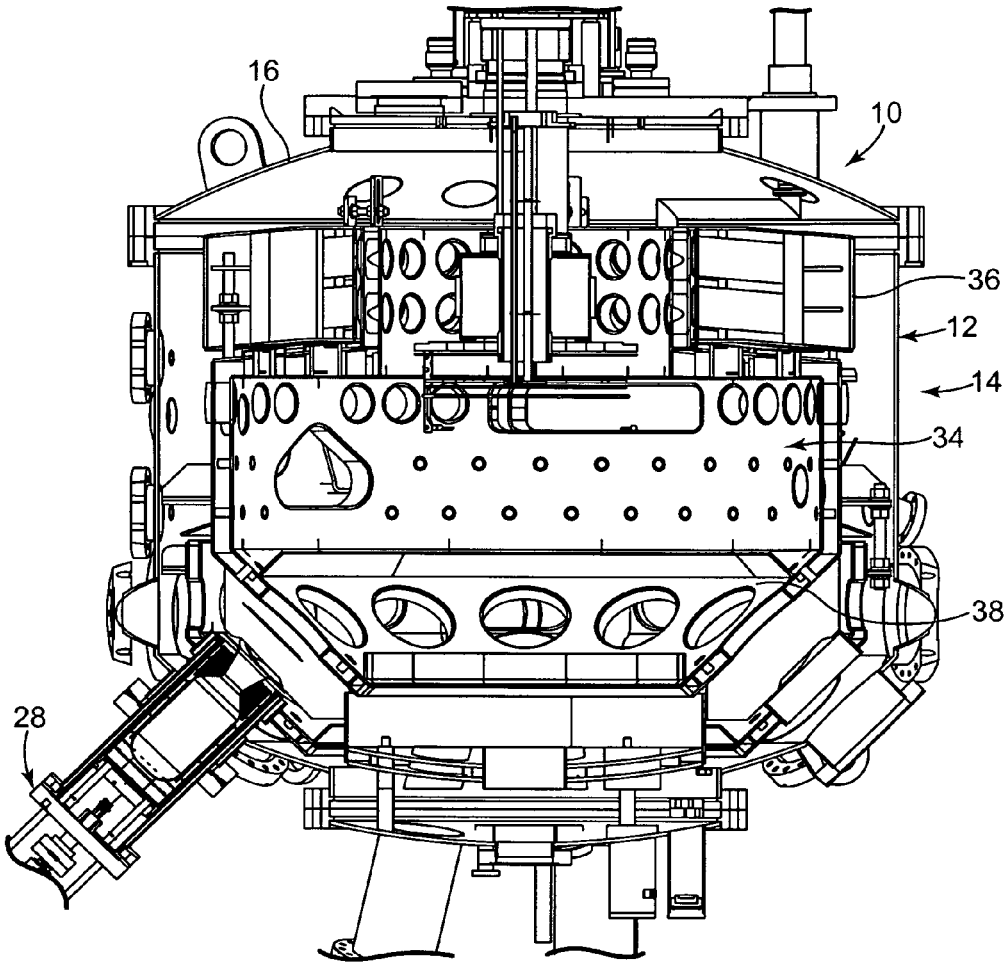
FIG. 13 is a cross-sectional view of the vacuum deposition system of FIG. 1.

Referring to FIG. 13, vacuum deposition system 10 is illustrated in cross-section. As shown, substrate platen 118 is positioned in vacuum chamber 12 by substrate manipulator 18. The location of substrate platen 118 generally defines a deposition region. Deposition source 28 is positioned to direct deposition material into vacuum chamber 12 to deposit on one or more substrates held by substrate platen 118. Pumping and cooling system 14 is positioned within vacuum chamber 12 and generally surrounds substrate platen 118. Additionally, vacuum deposition system 10 preferably includes liquid cooled shield 120, which preferably functions to absorb radiant heat from substrate platen 118 as heated by substrate manipulator 18.

As shown, cooling panel 34 and liquid cooled shield 120 preferably substantially block or shield radiant heat from radiative sources such as substrate manipulator 28 and deposition source 28 from upper and lower cryogenic panels 36 and 38 while allowing upper and lower cryogenic panels 36 and 38 to provide a desired pumping function during a deposition process. Lower cryogenic panel 38 is nested with and spaced from cooling panel 34 and preferably functions to pump gas from around deposition source 28. Upper cryogenic panel 36 is nested with and spaced from cooling panel 34 and preferably functions to pump gas from around substrate manipulator 28.

During a typical deposition process, deposition material from deposition source 28 is directed to substrate platen 118. Some deposition material deposits on one or more substrates held by substrate platen 118, some is pumped away by pumps of deposition system 10, and some is pumped by upper cryogenic panel 26. In the case of volatile or high vapor pressure materials, it is generally desirable to minimize reevaporation of such gas once it is condensed on a surface of upper cryogenic panel 36. Cooling panel 34 thus substantially shields radiant heat from reaching upper cryogenic panel 36 and allows pumping conductance to upper cryogenic panel 36. Specifically, openings 49 in neck portion 46 of upper cryogenic panel 36 allow gas to pass from the deposition region to the upper cryogenic panel 36. Openings 49 preferably correspond with tubes 76 and 78, which provide surface area for pumping. As noted above, tubes 76 and 78 are preferably angled or tilted slightly downwardly to minimize radiant heat from substrate manipulator 18 or other heat sources from reaching the inside surfaces of tubes 76 and 78.

The present invention has now been described with reference to several embodiments thereof. The entire disclosure of any patent or patent application identified herein is hereby incorporated by reference. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the structures described herein, but only by the structures described by the language of the claims and the equivalents of those structures.

What is claimed is:

1. An ultra high vacuum deposition system, the deposition system comprising:

a vacuum chamber comprising a deposition region wherein a substrate can be positioned for deposition and a port that can operatively position a source of deposition material relative to the deposition region; and a cooling and pumping system comprising:

a liquid cooling panel at least partially surrounding the deposition region; and a cryogenic pumping panel distinct from the liquid cooling panel and at least partially surrounding the liquid cooling panel wherein the liquid cooling panel substantially shields the cryogenic pumping panel from thermal radiation generated by the source of deposition material when the source of deposition material is positioned in the port wherein the liquid cooling panel comprises a plurality of openings that allow gas to move from the deposition region to the cryogenic pumping panel.

2. The deposition system of claim 1, wherein the liquid cooling panel comprises a body portion and a neck portion extending from the body portion.

3. The deposition system of claim 2, wherein the neck portion of the liquid cooling panel is annular.

4. The deposition system of claim 2, wherein the cryogenic pumping panel is nested with the neck of the liquid cooling panel.

5. The deposition system of claim 2, wherein the body portion of the liquid cooling panel comprises an opening aligned with the port for receiving the source of deposition material when the source of deposition material is positioned in the port.

6. The deposition system of claim 1, wherein the cryogenic pumping panel comprises an annular body.

7. The deposition system of claim 6, wherein the annular body comprises a plurality of radially extending chambers.

8. The deposition system of claim 6, wherein the annular body comprises a plurality of tubes extending between an inside and outside surface of the annular body.

9. The deposition system of claim 1, further comprising at least one additional port for at least one additional source of deposition material.

10. The deposition system of claim 1, in combination with a source of deposition material.

11. The deposition system of claim 1, in combination with a substrate heater.

* * * * *